US008561727B1

(12) United States Patent
Pope et al.

(10) Patent No.: US 8,561,727 B1
(45) Date of Patent: Oct. 22, 2013

(54) SUPERABRASIVE CUTTING ELEMENTS AND SYSTEMS AND METHODS FOR MANUFACTURING THE SAME

(75) Inventors: Bill J. Pope, Springville, UT (US); Louis M. Pope, Diani (KE)

(73) Assignee: US Synthetic Corporation, Orem, UT (US)

( * ) Notice: Subject to any disclaimer, the term of this patent is extended or adjusted under 35 U.S.C. 154(b) by 265 days.

(21) Appl. No.: 12/914,708

(22) Filed: Oct. 28, 2010

Related U.S. Application Data

(60) Provisional application No. 61/255,704, filed on Oct. 28, 2009.

(51) Int. Cl.
*E21B 10/08* (2006.01)

(52) U.S. Cl.
USPC ..... 175/331; 175/428; 175/420.01; 407/119

(58) Field of Classification Search
USPC ..... 175/331, 374, 428, 426, 434, 432, 425; 407/71, 119; 83/13
See application file for complete search history.

(56) References Cited

U.S. PATENT DOCUMENTS

| | | | | |
|---|---|---|---|---|
| 4,224,380 | A | 9/1980 | Bovenkerk et al. | |
| 4,268,276 | A | 5/1981 | Bovenkerk | |
| 4,373,593 | A * | 2/1983 | Phaal et al. | 175/430 |
| 4,410,054 | A | 10/1983 | Nagel et al. | |
| 4,468,138 | A | 8/1984 | Nagel | |
| 4,560,014 | A | 12/1985 | Geczy | |
| 4,738,322 | A | 4/1988 | Hall et al. | |
| 4,784,023 | A | 11/1988 | Dennis | |
| 4,797,138 | A | 1/1989 | Komanduri | |
| 4,811,801 | A | 3/1989 | Salesky et al. | |
| 4,913,247 | A | 4/1990 | Jones | |
| 5,016,718 | A | 5/1991 | Tandberg | |
| 5,092,687 | A | 3/1992 | Hall | |
| 5,120,327 | A | 6/1992 | Dennis | |
| 5,127,923 | A | 7/1992 | Bunting et al. | |
| 5,135,061 | A | 8/1992 | Newton, Jr. | |
| 5,154,245 | A | 10/1992 | Waldenstrom et al. | |
| 5,364,192 | A | 11/1994 | Damm et al. | |
| 5,368,398 | A | 11/1994 | Damm et al. | |
| 5,460,233 | A | 10/1995 | Meany et al. | |
| 5,480,233 | A | 1/1996 | Cunningham | |
| 5,544,713 | A | 8/1996 | Dennis | |
| 6,793,681 | B1 | 9/2004 | Pope et al. | |
| 2009/0178855 | A1 | 7/2009 | Zhang et al. | |
| 2009/0183925 | A1 | 7/2009 | Zhang et al. | |

* cited by examiner

*Primary Examiner* — Yong-Suk (Philip) Ro
(74) *Attorney, Agent, or Firm* — ALG Intellectual Property, LLC

(57) ABSTRACT

An exemplary cutting element for a rotary drill bit may have a forward end and a rearward end. The cutting element may include a substrate having a forward face, a rearward face, and at least one interface surface extending between the forward end and the rearward end. At least one of the forward face and the rearward face may be a substantially planar surface. The cutting element may also include a superabrasive layer bonded to the at least one interface surface of the substrate. The superabrasive layer may include at least one cutting edge extending between the forward end and the rearward end. An exemplary rotary drill bit may include at least one cutting element coupled to the bit body. The at least one cutting element may have a rearward end adjacent to the bit body and a forward end extending away from the bit body.

19 Claims, 5 Drawing Sheets

SUPERABRASIVE CUTTING ELEMENTS AND SYSTEMS AND METHODS FOR MANUFACTURING THE SAME

CROSS REFERENCE TO RELATED APPLICATION

This application claims priority to U.S. Provisional Application No. 61/255,704, titled "Superabrasive Cutting Elements and Systems and Methods for Manufacturing the Same" and filed 28 Oct. 2009, the disclosure of which is incorporated, in its entirety, by this reference.

BACKGROUND

Wear-resistant, superabrasive materials are traditionally utilized for a variety of mechanical applications. For example, polycrystalline diamond ("PCD") materials are often used in drilling tools (e.g., cutting elements, gage trimmers, etc.), machining equipment, bearing apparatuses, wire-drawing machinery, and in other mechanical systems. Conventional superabrasive materials have found utility as superabrasive cutting elements in rotary drill bits, such as roller cone drill bits and fixed-cutter drill bits. A conventional cutting element may include a disc-shaped superabrasive layer or table, such as a PCD table, bonded to a cylindrical substrate.

Cutting elements having a PCD table may be formed and bonded to an end surface of a substrate using an ultra-high pressure, ultra-high temperature ("HPHT") sintering process. A conventional cutting element may comprise a cylindrical substrate having a disc-shaped PCD table bonded to an end surface of the substrate. Often, a cutting element having a PCD table is fabricated by placing a cemented carbide substrate, such as a cobalt-cemented tungsten carbide substrate, into a container or cartridge with a volume of diamond particles positioned on an end surface of the cemented carbide substrate. The substrate and diamond particle volume may be processed under HPHT conditions in the presence of a catalyst material that causes the diamond particles to bond to one another to form a diamond table having a matrix of bonded diamond crystals. The catalyst material is often a metal-solvent catalyst, such as cobalt, nickel, and/or iron, that facilitates intergrowth and bonding of the diamond crystals. A number of cartridges containing substrates and diamond particle volumes may be loaded into a HPHT press. Commonly used HPHT presses include cubic, belt, and prismatic presses.

Cutting elements may be secured to drill bits by brazing, press-fitting, or otherwise securing the cutting elements into preformed pockets, sockets, or other mounting receptacles formed in a rotary drill bit. In some configurations, the cutting element substrates may be brazed or otherwise joined to attachment members such as studs or cylindrical backings. Generally, a rotary drill bit may include one or more PCD cutting elements affixed to a bit body of the rotary drill bit. Cutting elements are often mounted to a drill bit so that edge portions, or cutting edges, of the PCD tables face generally toward a rock formation being drilled.

As a rock formation is drilled, cutting edges of PCD tables on the cutting elements may cut away portions of the rock formation. Over time, the cutting edges of the PCD tables may become worn due to various forces that the PCD tables are subjected to during drilling. As the cutting edges of the PCD tables are worn, the cutting edges may become progressively more planar and/or rounded and the cutting effectiveness of the cutting elements may be reduced significantly. Eventually, the cutting elements on drill bits may need to be replaced, leading to delays in drilling operations and added expense to remove the cutting elements and install new cutting elements on the drill bits. Such delays may cause unnecessary downtime and production losses.

SUMMARY

The instant disclosure is directed to exemplary cutting elements for rotary drill bits. According to at least one embodiment, a cutting element may comprise a forward end, a rearward end, and a substrate. The substrate may comprise a forward face, a rearward face, and at least one interface surface extending between the forward end and the rearward end. At least one of the forward face and the rearward face may comprise a substantially planar surface. The cutting element may also comprise a superabrasive layer bonded to the at least one interface surface of the substrate (e.g., a layer formed of a polycrystalline diamond material). The superabrasive layer may include at least one cutting edge extending between the forward end and the rearward end. In at least one embodiment, the forward face may be substantially parallel to the rearward face.

According to some embodiments, the at least one interface surface may comprise a substantially planar surface and/or an arcuate surface. In at least one embodiment, the substrate may include an arcuate side surface (e.g., a semi-cylindrical side surface) extending from the at least one interface surface. The at least one cutting edge may be formed where the at least one interface surface intersects the arcuate side surface. In some embodiments, the superabrasive layer may comprise a serrated cutting edge having a plurality of cutting points and a plurality of grooves defined between the cutting points. In various embodiments, the at least one interface surface may comprise two interface surfaces and the at least one cutting edge may be formed where the two interface surfaces intersect. In certain embodiments, the at least one interface surface of the substrate may comprise a plurality of spaced apart ridges forming grooves therebetween and the superabrasive layer may occupy the grooves such that the superabrasive layer is interlocked with the ridges of the substrate.

According to some embodiments, the at least one cutting element may comprise at least one cutting point that is formed where the at least one interface surface and the forward face intersect. In at least one embodiment, the at least one cutting point may be formed where the at least one interface surface, the forward face, and an arcuate side surface extending from the at least one interface surface intersect. In certain embodiments, the at least one interface surface may comprise two interface surfaces and the at least one cutting point may be formed where the two interface surfaces and the forward face intersect.

The instant disclosure is also directed to exemplary rotary drill bits. According to at least one embodiment, a rotary drill bit may include a bit body that is rotatable about a longitudinal axis in a rotational direction and at least one cutting element coupled to the bit body. The at least one cutting element may comprise a rearward end adjacent to the bit body, a forward end extending away from the bit body, and a substrate. The substrate may comprise a forward face, a rearward face, and at least one interface surface extending between the forward end and the rearward end. The at least one cutting element may also comprise a superabrasive layer bonded to the at least one interface surface of the substrate, the superabrasive layer including at least one cutting edge extending between the forward end and the rearward end.

According to at least one embodiment, the forward face of the substrate may be within 30° of being perpendicular to the longitudinal axis. The substrate may also include an arcuate side surface that is positioned on a side of the at least one cutting element facing in a direction that is generally opposite the rotational direction. In various embodiments, the at least one interface surface may comprise two interface surfaces and the at least one cutting edge may be formed where the two interface surfaces intersect. The at least one cutting edge may be positioned on a side of the at least one cutting element facing generally in the rotational direction.

According to some embodiments, the rotary drill bit may comprise at least one bit blade having a leading face that faces generally in the rotational direction. The at least one cutting element may be mounted on the at least one bit blade such that the at least one cutting edge is positioned rotationally preceding the leading face in the rotational direction. The at least one cutting element may be mounted to the at least one bit blade such that the forward face of the at least one cutting element is within 30° of being perpendicular to the leading face of the at least one bit blade.

Features from any of the embodiments described herein may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1A:
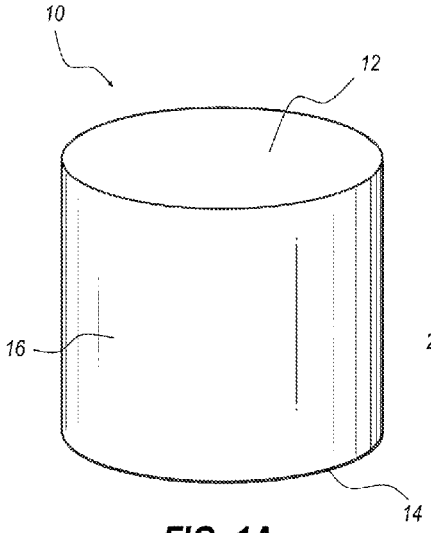
FIG. 1A is a perspective view of an exemplary substrate blank according to at least one embodiment.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

The instant disclosure is directed to superabrasive articles, such as superabrasive cutting elements, and drill bits used in drilling and/or cutting operations. The cutting elements disclosed herein may be used in a variety of applications, such as drilling tools, machining equipment, cutting tools, and other apparatuses, without limitation. The instant disclosure is also directed to systems and methods for manufacturing superabrasive cutting elements.

As used herein, the terms "superabrasive" and "superhard" may refer to materials exhibiting a hardness exceeding a hardness of tungsten carbide. For example, a superabrasive article may represent an article of manufacture, at least a portion of which may exhibit a hardness exceeding the hardness of tungsten carbide. As used herein, the term "cutting" may refer broadly to drilling processes, boring processes, machining processes, and/or any other material removal process utilizing a cutting element.

FIG. 1A is a perspective view of an exemplary substrate blank 10 according to at least one embodiment. Substrate blank 10 may comprise a forward face 12, a rearward face 14, and a peripheral surface 16. According to various embodiments, substrate blank 10 may comprise a substantially cylindrical volume, as illustrated in FIG. 1A. Forward face 12 and rearward face 14 may comprise end surfaces of cylindrical substrate blank 10 and peripheral surface 16 may comprise a peripheral side surface of cylindrical substrate blank 10 extending between forward face 12 and rearward face 14. In additional embodiments, substrate blank 10 may comprise a non-cylindrical-shaped volume.

Substrate blank 10 may comprise any suitable material on which a superabrasive table, such as a polycrystalline diamond table, may be formed. In at least one embodiment, substrate blank 10 may comprise a cemented carbide material, such as a cobalt-cemented tungsten carbide material and/or any other suitable material. Further, substrate blank 10 may include a suitable metal-solvent catalyst material, such as, for example, cobalt, nickel, iron, and/or alloys thereof. Substrate blank 10 may also include any other suitable material including, without limitation, cemented carbides such as titanium carbide, niobium carbide, tantalum carbide, vanadium carbide, chromium carbide, and/or combinations of any of the preceding carbides cemented with iron, nickel, cobalt, and/or alloys thereof.

Figure 1B:
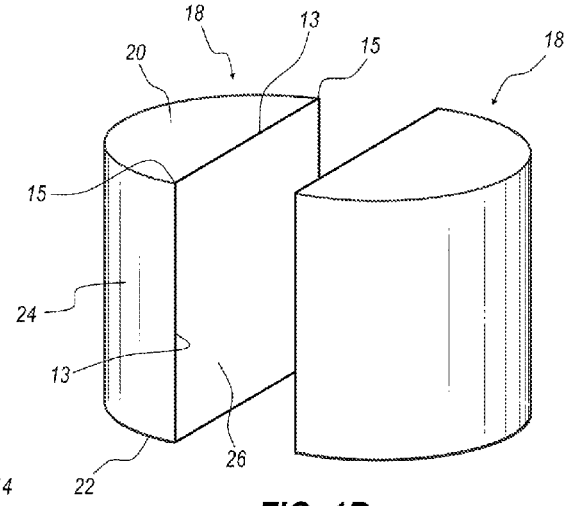
FIG. 1B is a perspective view of exemplary substrates formed from the substrate blank illustrated in FIG. 1A according to at least one embodiment.

FIG. 1B is a perspective view of exemplary substrates 18 formed from a substrate blank, such as substrate blank 10 illustrated in FIG. 1A, according to at least one embodiment. Substrate blank 10 may be divided into two or more substrates using any suitable technique, such as, for example, a wire-electrical-discharge machining ("wire EDM") process. For example, substrate blank 10 may be cut in a length-wise direction to form two substrates 18 having semi-circular cross-sections. In additional embodiments, substrates 18 may be formed independently through molding, machining, and/or any other suitable technique, without limitation. Substrates 18 may be substantially similar in size and/or shape, as illustrated in FIG. 1B. In additional embodiments, substrates 18 may have different sizes, shapes, and/or geometries, without limitation.

As shown in FIG. 1B, substrates 18 may each have a forward face 20 formed from a portion of forward face 12 of substrate blank 10, a rearward face 22 formed from a portion of rearward face 14 of substrate blank 10, and an arcuate side surface 24 formed from a portion of peripheral surface 16 of substrate blank 10. In some embodiments, forward face 20 and/or rearward face 22 may comprise a substantially planar surface. In at least one embodiment, forward face 20 may be substantially parallel to rearward face 22. According to various embodiments, arcuate side surface 24 may comprise a semi-cylindrical surface formed from a portion of cylindrical peripheral surface 16 of substrate blank 10. Additionally, substrates 18 may each comprise an interface surface 26 for bonding a superabrasive layer thereto. As illustrated in FIG. 1B, interface surface 26 may comprise a surface formed by the division of substrate blank 10 to form substrates 18.

Interface surface 26 may have any shape suitable for bonding to a superabrasive layer, such as a polycrystalline diamond layer, without limitation. For example, interface surface 26 may comprise a substantially planar and/or rectangular surface, as shown in FIG. 1B. In other embodiments, interface surface 26 may be nonplaner. According to various embodiments, each substrate 18 may include one or more edges 13 where interface surface 26 intersects an adjacent surface, such as forward face 20 or arcuate side surface 24. Each substrate 18 may also include one or more points 15 where interface surface 26 intersects at least two surfaces, such as forward face 20 and arcuate side surface 24.

Figure 2:
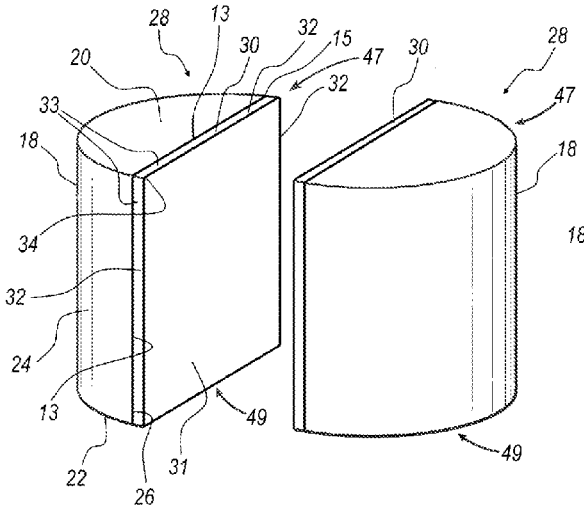
FIG. 2 is a perspective view of exemplary cutting elements comprising the exemplary substrates illustrated in FIG. 1B according to at least one embodiment.
Figure 3:
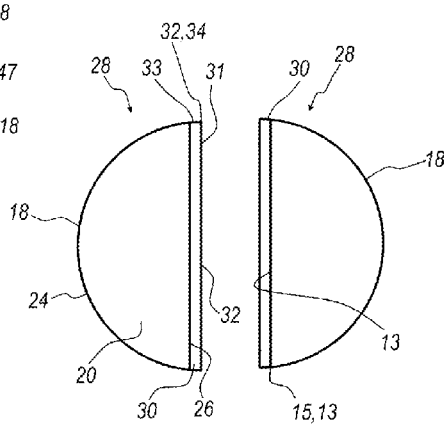
FIG. 3 is a top view of the exemplary cutting elements illustrated in FIG. 2.

FIGS. 2 and 3 illustrate cutting element 28 comprising the exemplary substrates 18 illustrated in FIG. 1B. FIG. 2 is a perspective view of exemplary cutting elements 28 comprising substrates 18, according to at least one embodiment. FIG. 3 is a top view of the exemplary cutting elements illustrated in FIG. 2. As illustrated in FIGS. 2 and 3, cutting elements 28 may each comprise a forward end 47, a rearward end 49, and a superabrasive layer 30 affixed to or formed upon interface surface 26 of substrate 18 so as to extend between forward end 47 and rearward end 49. Each of cutting elements 28 may also comprise a superabrasive face 31, at least one superabrasive edge 32, at least one superabrasive side surface 33, and at least one superabrasive point 34 formed by superabrasive layer 30.

Superabrasive edges 32 may each comprise an angular, beveled, and/or rounded edge formed where a peripheral side of superabrasive face 31 intersects a superabrasive side surface 33. In various embodiments, superabrasive edges 32 may comprise chamfered surfaces or other selected geometries (e.g., one or more radiuses and/or one or more chamfers, etc.) extending between superabrasive face 31 and superabrasive side surfaces 33. As illustrated in FIGS. 2 and 3, superabrasive edges 32 may be formed where interface surface 26 intersects forward face 20 or arcuate side surface 24.

Superabrasive points 34 may each comprise an angular, beveled, and/or rounded point or projection formed by three or more surfaces at the intersection of superabrasive face 31 and at least two superabrasive side surfaces 33, as illustrated in FIG. 2. Superabrasive points 34 may also comprise chamfered surfaces or other selected geometries, without limitation. As shown in FIGS. 2 and 3, superabrasive points 34 may be formed where interface surface 26 intersects forward face 20 and arcuate side surface 24. One or more of superabrasive edges 32 and/or superabrasive points 34 may act as cutting edges and/or cutting points during drilling and/or cutting operations.

Superabrasive layers 30 may be formed of any suitable superabrasive and/or superhard material or combination of materials, including, for example, PCD. According to additional embodiments, superabrasive layers 30 may comprise cubic boron nitride, silicon carbide, diamond, and/or mixtures or composites including one or more of the foregoing materials. Superabrasive layers 30 may be formed using any suitable technique, as described in greater detail below with reference to FIGS. 8 and 9 below. For example, superabrasive layers 30 may comprise PCD layers formed by subjecting a plurality of diamond particles (e.g., diamond particles having an average particle size between approximately 0.5 μm and approximately 150 μm) to a HPHT sintering process in the presence of a metal-solvent catalyst, such as cobalt, nickel, iron, and/or any other suitable group VIII element or alloys thereof.

Figure 4:
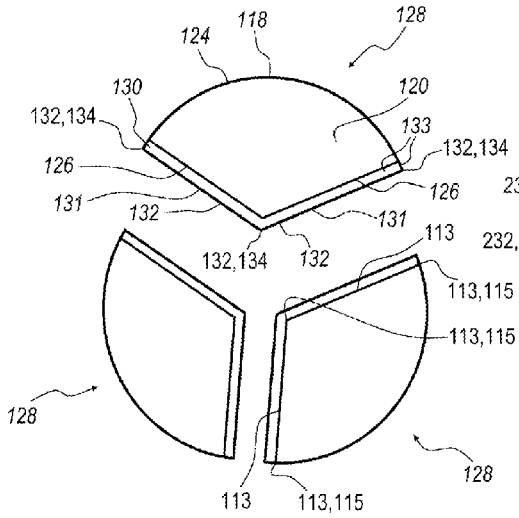
FIG. 4 is a top view of exemplary cutting elements according to at least one embodiment.

FIGS. 4-6B illustrate cutting elements comprising various substrates, such as substrates formed from the substrate blank 10 illustrated in FIG. 1A. FIG. 4 is a top view of exemplary cutting elements 128 according to at least one embodiment. As illustrated in this figure, cutting elements 128 may comprise substrates 118 formed from a substrate blank, such as substrate blank 10. For example, substrate blank 10 may be divided in a length-wise direction to form three substrates 118. Substrates 118 may also be formed independently through molding, machining, and/or any other suitable technique, without limitation. Substrates 118 may be substantially similar in size and/or shape, as illustrated in FIG. 4. In additional embodiments, substrates 118 may have different sizes, shapes, and/or geometries, without limitation.

Substrates 118 may each have a forward face 120, a rearward face (e.g. rearward face 22 illustrated in FIG. 1B) opposite forward face 120, and an arcuate side surface 124 formed from a portion of peripheral surface 16 of substrate blank 10. In some embodiments, forward face 120 and/or a rearward face opposite forward face 120 may comprise a substantially planar surface. In at least one embodiment, forward face 120 may be substantially parallel to a rearward face opposite forward face 120. Additionally, as illustrated in FIG. 4, substrates 118 may each comprise at least two interface surfaces 126 for bonding superabrasive layer 130. Interface surfaces 126 may comprise surfaces formed by the division of substrate blank 10 to form substrates 118, such as a substantially planar and/or rectangular surface. According to various embodiments, each substrate 118 may include one or more edges 113 where interface surface 126 intersects an adjacent surface, such as forward face 120 or arcuate side surface 124. Each substrate 118 may also include points 115 where interface surface 126 intersects at least two surfaces, such as forward face 120 and arcuate side surface 124.

Cutting elements 128 may each comprise a superabrasive layer 130 affixed to or formed upon interface surfaces 126 of substrate 118. Each of cutting elements 128 may also comprise superabrasive faces 131, superabrasive edges 132, superabrasive side surfaces 133, and superabrasive points 134 formed by superabrasive layer 130. Superabrasive edges 132 may each comprise an angular, beveled, and/or rounded edge formed where a superabrasive face 131 intersects a superabrasive side surface 133. Each superabrasive edge 132 may also comprise an edge formed where two superabrasive faces 131 intersect. In various embodiments, superabrasive edges 132 may comprise chamfered surfaces or other selected geometries (e.g., one or more radiuses and/or one or more chamfers, etc.). As illustrated in FIG. 4, superabrasive edges 132 may be formed where interface surfaces 126 intersect forward faces 120 or arcuate side surfaces 124.

Superabrasive points 134 may each comprise an angular, beveled, and/or rounded point or projection formed by three or more superabrasive surfaces. For example, a superabrasive point 134 may be formed where a superabrasive face 131 and two superabrasive side surfaces 133 intersect or where two superabrasive faces 131 and a superabrasive side surface 133 intersect. In various embodiments, superabrasive points 134 may comprise chamfered surfaces or other selected geometries, without limitation. As shown in FIG. 4, superabrasive points 134 may be formed where interface surfaces 126 intersect forward faces 120 and arcuate side surfaces 124. One or more of superabrasive edges 132 and/or superabrasive points 134 may act as cutting edges and/or cutting points during drilling and/or cutting operations.

Figure 5:
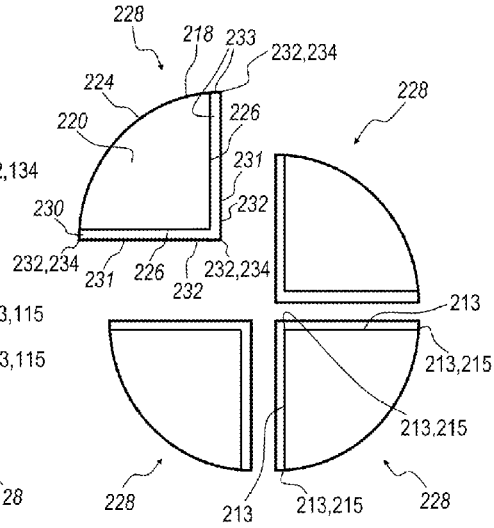
FIG. 5 is a top view of exemplary cutting elements according to at least one embodiment.

FIG. 5 is a top view of exemplary cutting elements 228 according to at least one embodiment. As illustrated in this figure, cutting elements 228 may comprise substrates 218 formed from a substrate blank, such as substrate blank 10. For example, substrate blank 10 may be divided in a length-wise direction to form four substrates 218. Substrates 218 may also be formed independently through molding, machining, and/or any other suitable technique, without limitation. Substrates 218 may be substantially similar in size and/or shape, as illustrated in FIG. 5. In additional embodiments, substrates 218 may have different sizes, shapes, and/or geometries, without limitation.

Substrates 218 may each have a forward face 220, a rearward face (e.g. rearward face 22 illustrated in FIG. 1B) opposite forward face 220, and an arcuate side surface 224 formed from a portion of peripheral surface 16 of substrate blank 10. In some embodiments, forward face 220 and/or a rearward face opposite forward face 220 may comprise a substantially planar surface. In at least one embodiment, forward face 220 may be substantially parallel to a rearward face opposite forward face 220. Additionally, as illustrated in FIG. 5, substrates 218 may each comprise at least two interface surfaces 226 for bonding superabrasive layer 230 thereto. Interface surfaces 226 may comprise surfaces formed by the division of substrate blank 10 to form substrates 218, such as a substantially planar and/or rectangular surface. According to various embodiments, each substrate 218 may include one or more edges 213 where interface surface 226 intersects an adjacent surface, such as forward face 220 or arcuate side surface 224. Each substrate 218 may also include points 215 where interface surface 226 intersects at least two surfaces, such as forward face 220 and arcuate side surface 224.

Cutting elements 228 may each comprise a superabrasive layer 230 affixed to or formed upon interface surfaces 226 of substrate 218. Each of cutting elements 228 may also comprise superabrasive faces 231, superabrasive edges 232, superabrasive side surfaces 233, and superabrasive points 234 formed by superabrasive layer 230. Superabrasive edges 232 may each comprise an angular, beveled, and/or rounded edge formed where a peripheral side of a superabrasive face 231 intersects a superabrasive side surface 233. Superabrasive edges 232 may also comprise an edge formed where two superabrasive faces 231 intersect. In various embodiments, superabrasive edges 232 may comprise chamfered surfaces or other selected geometries (e.g., one or more radiuses and/or one or more chamfers, etc.). As illustrated in FIG. 5, superabrasive edges 232 may be formed where interface surfaces 226 intersect forward faces 220 or arcuate side surfaces 224.

Superabrasive points 234 may each comprise an angular, beveled, and/or rounded point or projection formed by three or more superabrasive surfaces. For example, a superabrasive point 234 may be formed where a superabrasive face 231 and two superabrasive side surfaces 233 intersect or where two superabrasive faces 231 and a superabrasive side surface 233 intersect. In various embodiments, superabrasive points 234 may comprise chamfered surfaces or other selected geometries, without limitation. As shown in FIG. 5, superabrasive points 234 may be formed where interface surfaces 226 intersect forward faces 220 and arcuate side surfaces 224. One or more of superabrasive edges 232 and/or superabrasive points 234 may act as cutting edges and/or cutting points during drilling and/or cutting operations.

Figure 6A:
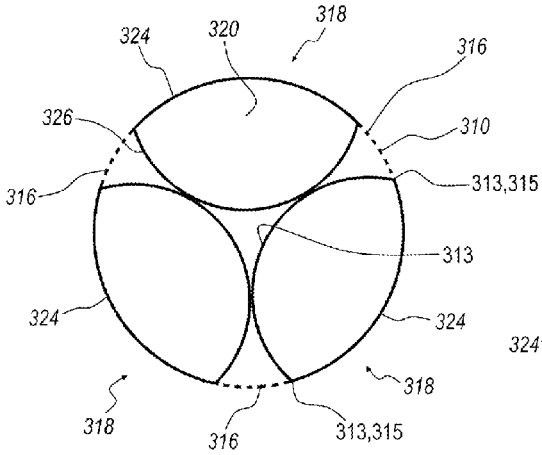
FIG. 6A is a top view of exemplary substrates according to at least one embodiment.

FIG. 6A is a top view of exemplary substrates 318 according to at least one embodiment. As illustrated in this figure, substrates 318 may be formed from a substrate blank 310 having a peripheral surface 316 (see, e.g., substrate blank 10 illustrated in FIG. 1A). An outline of substrate blank 310 is shown in FIG. 6A to illustrate portions of substrate blank 310 that may be used to form substrates 318. For example, substrate blank 310 may be divided in a length-wise direction to form substrates 318 having arcuate interface surfaces 326. Substrates 318 may also be formed independently through molding, machining, and/or any other suitable technique, without limitation. Substrates 318 may be substantially similar in size and/or shape, as illustrated in FIG. 6A. In additional embodiments, substrates 318 may have different sizes, shapes, and/or geometries, without limitation.

Substrates 318 may each have a forward face 320, a rearward face (e.g. rearward face 22 illustrated in FIG. 1B) opposite forward face 320, and an arcuate side surface 324 formed from a portion of peripheral surface 316 of substrate blank 310. In some embodiments, forward face 320 and/or a rearward face opposite forward face 320 may comprise a substantially planar surface. In at least one embodiment, forward face 320 may be substantially parallel to a rearward face opposite forward face 320. According to various embodiments, as illustrated in FIG. 6A, each substrate 318 may include one or more edges 313 where arcuate interface surface 326 intersects an adjacent surface, such as forward face 320 or arcuate side surface 324. Each substrate 318 may also include points 315 where arcuate interface surface 326 intersects at least two surfaces, such as forward face 320 and arcuate side surface 324.

Figure 6B:
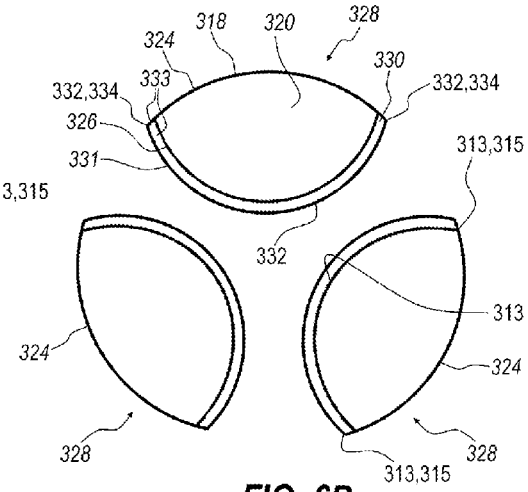
FIG. 6B is a top view of exemplary cutting elements according to at least one embodiment.

FIG. 6B is a top view of exemplary cutting elements 328 according to at least one embodiment. Cutting elements 328 may comprise substrates 318, as illustrated in FIG. 6A. Cutting elements 328 may each comprise a superabrasive layer 330 affixed to or formed upon arcuate interface surface 326 of substrate 318. Each cutting element 328 may also comprise an arcuate superabrasive face 331, superabrasive edges 332, superabrasive side surfaces 333, and superabrasive points 334 formed by superabrasive layer 330. Superabrasive edges 332 may each comprise an angular, beveled, and/or rounded edge formed where a peripheral side of arcuate superabrasive face 331 intersects a superabrasive side surface 333. In various embodiments, superabrasive edges 332 may comprise chamfered surfaces or other selected geometries (e.g., one or more radiuses and/or one or more chamfers, etc.) extending between superabrasive face 331 and superabrasive side surfaces 333. As illustrated in FIG. 6B, superabrasive edges 332 may be formed where arcuate interface surfaces 326 intersect forward faces 320 or arcuate side surfaces 324.

Superabrasive points 334 may each comprise an angular, beveled, and/or rounded point or projection formed by three or more superabrasive surfaces. Superabrasive points 334 may also comprise chamfered surfaces or other selected geometries, without limitation. For example, a superabrasive point 334 may be formed where superabrasive face 331 and two superabrasive side surfaces 333 intersect. In various embodiments, superabrasive points 334 may comprise chamfered surfaces or other selected geometries, without limitation. As shown in FIG. 6B, superabrasive points 334 may be formed where arcuate interface surfaces 326 intersect forward faces 320 and arcuate side surfaces 324. One or more of superabrasive edges 332 and/or superabrasive points 334 may act as cutting edges and/or cutting points during drilling and/or cutting operations.

Figure 7A:
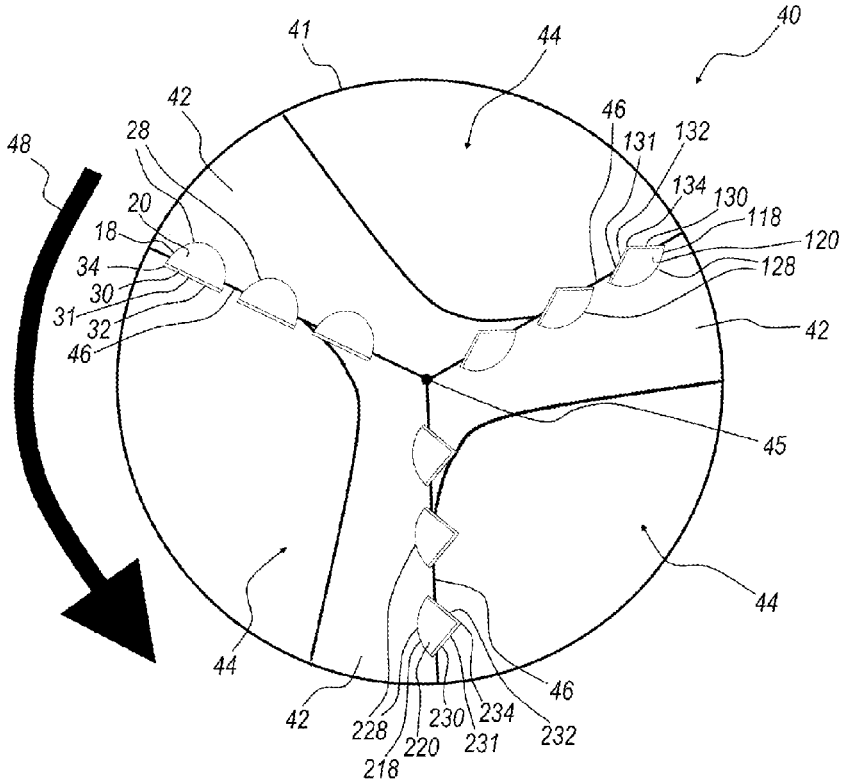
FIG. 7A is a top view of an exemplary drill bit comprising cutting elements according to at least one embodiment.
Figure 7B:
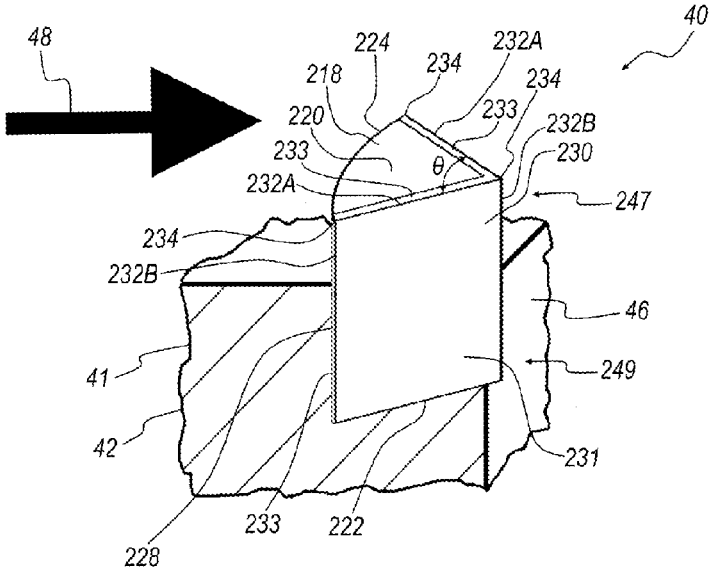
FIG. 7B is a partial cross-sectional perspective view of a portion of the exemplary drill bit illustrated in FIG. 7A.

FIGS. 7A and 7B show cutting elements mounted to a drill bit according to various embodiments. FIG. 7A is a top view of an exemplary drill bit 40 comprising at least one cutting element fabricated and structured in accordance with the disclosed embodiments, such as one or more previously described cutting elements 28, 128, 228, and/or 328, without limitation. Drill bit 40 may additionally represent any number of earth-boring tools or drilling tools, including, for example, core bits, roller-cone bits, fixed-cutter bits, eccentric bits, bicenter bits, reamers, reamer wings, and/or any other downhole tools comprising superabrasive cutting elements and/or discs, without limitation.

The superabrasive elements and discs disclosed herein may also be utilized in applications other than cutting technology. For example, embodiments of superabrasive elements and/or discs disclosed herein may also form all or part of heat sinks, wire dies, bearing elements, cutting elements, cutting inserts (e.g., on a roller cone type drill bit), machining inserts, or any other article of manufacture, as known in the art. According to some examples, superabrasive elements and/or discs, as disclosed herein, may be employed in medical device applications, including, without limitation, hip joints, back joints, or any other suitable medical joints. Thus, superabrasive elements and discs, as disclosed herein, may be employed in any suitable article of manufacture that includes a superabrasive element, disc, or layer. Other examples of articles of manufacture that may incorporate superabrasive elements as disclosed herein may be found in U.S. Pat. Nos. 4,811,801; 4,268,276; 4,410,054; 4,468,138; 4,560,014; 4,738,322; 4,913,247; 5,016,718; 5,092,687; 5,120,327; 5,135,061; 5,154,245; 5,364,192; 5,368,398; 5,460,233; 5,544,713; 5,480,233; and 6,793,681, the disclosure of each of which is incorporated herein, in its entirety, by this reference.

As illustrated in FIG. 7A, drill bit 40 may comprise a bit body 41 having a longitudinal axis 45. At least one cutting element, such as one or more previously described cutting elements 28, 128, 228, and/or 328, may be coupled to bit body 40. In various embodiments, bit body 41 may define a leading end structure comprising cutting elements, such as cutting elements 28, 128, 228, and/or 328, for drilling into a subterranean formation by rotating bit body 41 about longitudinal axis 45 in rotational direction 48 and applying weight to bit body 41.

Bit body 41 may include radially and longitudinally extending blades 42 with leading faces 46 facing generally in rotational direction 48. Circumferentially adjacent blades 42 may define so-called junk slots 44 therebetween. Junk slots 44 may be configured to channel debris, such as rock or formation cuttings, away from cutting elements during drilling. In additional examples, bit body 41 may include nozzle cavities for communicating drilling fluid from the interior of drill bit 40 to the cutting elements during drilling. In some embodiments, bit body 41 may also include a threaded pin connection positioned opposite the leading end structure for connecting bit body 41 to a drill string.

FIG. 7A shows rows of cutting elements 28, 128, and 228 mounted to respective bit blades 42 on bit body 41. Although not illustrated in FIG. 7A, cutting elements 328 and/or any other suitable cutting elements, without limitation, may also be mounted to bit body 41. In some embodiments, drill bit 40 may comprise a plurality of rows of substantially similar cutting elements (e.g., drill bit 40 may comprise a plurality of rows of cutting elements 28).

In at least one embodiment, at least a portion of substrates 18, 118, and/or 218 (e.g., rearward end 249 illustrated in FIG. 7B) may be positioned adjacent to and/or generally facing toward bit blades 42. In some examples, bit body 41 may define recesses corresponding to substrates 18, 118, and/or 218. Substrates 18, 118, and/or 218 may be coupled to recesses is defined in bit body 41 through brazing, welding, press-fitting, using fasteners, or any another suitable mounting technique, without limitation.

As illustrated in FIG. 7A, cutting elements 28, 128, and 228 may be mounted and oriented on bit body 41 so that portions of the cutting elements comprising superabrasive layers 30, 130, and/or 230 face generally in the rotational direction 48. At least one of superabrasive faces 31, 131, and/or 231, superabrasive edges 32, 132, and/or 232, and/or superabrasive points 34, 134, and/or 234 may face generally in the rotational direction 48. In some examples, at least one of superabrasive faces 31, 131, and/or 231, superabrasive edges 32, 132, and/or 232, and/or superabrasive points 34, 134, and/or 234 may face generally to toward a formation being drilled when drill bit 40 is rotated in rotational direction 48 during drilling. According to some embodiments, cutting elements 28, 128, and/or 228 may be mounted on at least one of bit blades 42 such that superabrasive cutting edges 32, 132, and/or 232 are positioned rotationally preceding at least one of leading faces 46 in rotational direction 48.

In some embodiments, cutting elements 28, 128, and/or 228 may be oriented on bit body 41 so that rearward ends of the cutting elements (e.g., rearward end 249 illustrated in FIG. 7B) are adjacent to bit body 41 and forward ends of the cutting elements (e.g., forward end 247 illustrated in FIG. 7B) face generally outward from bit body 41. For example, cutting elements 28, 128, and/or 228 may be mounted to bit body 41 such that forward faces 20, 120, and/or 220 are within 30° of being perpendicular to at least one of leading faces 46. According to various embodiments, cutting elements 28, 128, and/or 228 may be oriented so that when drill bit 40 is rotated in rotational direction 48, superabrasive edges 32, 132, and/or 232, and/or superabrasive points 34, 134, and/or 234 may generally encounter portions of a formation being drilled prior to other portions of the cutting elements.

According to some embodiments, cutting elements 28, 128, and/or 228 may be oriented on a bit blade 42 so that superabrasive edges 32, 132, and/or 232 and/or superabrasive points 34, 134, and/or 234 form a generally clawed, serrated, and/or zigzag pattern of cutting surfaces extending from bit blade 42. Such a clawed, serrated, and/or zigzag pattern of cutting surfaces may facilitate effective cutting of a formation, such as a rock formation, during drilling.

FIG. 7B is a partial cross-sectional side view of a portion of exemplary drill bit 40 illustrated in FIG. 7A. FIG. 7B shows a portion of a bit blade 42 on which a cutting element 228 is mounted. Although cutting element 228 is illustrated in FIG. 7B, any other suitable cutting element, such as cutting element 28, 128, 328, and/or any other suitable cutting element, without limitation, may be similarly mounted and/or oriented on bit blade 42. According to various embodiments, cutting element 228 may comprise a forward end 247 and a rearward end 249. In at least one embodiment, rearward end 249 of cutting element 228 may be mounted adjacent to bit blade 42 and forward end 247 of cutting element 228 may extend outward from bit blade 42. As drill bit 40 is rotated in rotational direction 48, forward end 247 of cutting element 228 may be adjacent to and/or in contact with a formation, such as a rock formation being drilled by drill bit 40. In some embodiments, cutting element 228 may be mounted to bit blade 42 such that forward face 220 of substrate 218 is within 30° of being perpendicular to longitudinal axis 45.

As illustrated in FIG. 7B, forward end 247 of cutting element 228 may include at least one superabrasive edge 232A. Additionally, cutting element 228 may include at least one superabrasive edge 232B that extends between forward end 247 and rearward end 249 of cutting element 228. As drill bit 40 is rotated in rotational direction 48 during drilling, superabrasive layer 230 may contact portions of a formation being drilled prior to other portions of cutting element 228. For example, during drilling, superabrasive layer 230 may contact a portion of a formation before substrate 218 contacts the formation.

Superabrasive edges 232A or 232B may be manufactured to have a cutter angle, such as cutter angle θ, suitable for effectively removing material from selected rock formations. According to various embodiments, because superabrasive edges 232B extend from rearward end 249 to forward end 247 of cutting element 228, portions of superabrasive edges 232B that are not adjacent to forward face 220 of substrate 218 may not be worn during a drilling operation. As a forward portion of a superabrasive edge 232B of cutting element 228 is worn during drilling, a portion of superabrasive edge 232B directly behind the worn forward portion may substantially maintain the pre-formed cutter angle θ. Accordingly, as cutting element 228 is worn in a direction from forward end 247 to rearward end 249 of cutting element 228 during drilling, one or more of superabrasive edges 232B may substantially maintain the pre-formed cutter angle θ.

In some embodiments, because cutting element 228 may maintain a substantially constant pre-formed cutter angle θ as cutting element 228 is worn, drill bit 40 comprising one or more cutting elements 228 may maintain a substantially constant rate of penetration during drilling. Accordingly, drill bit 40 may be used effectively for a longer time period without requiring maintenance and/or repair of cutting elements 228 in comparison with a drill bit having conventional cutting elements.

Figure 8:
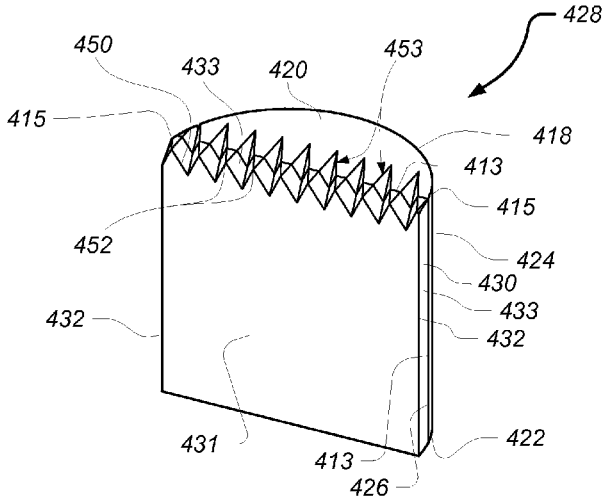
FIG. 8 is a perspective view of an exemplary cutting element according to at least one embodiment.
Figure 9:
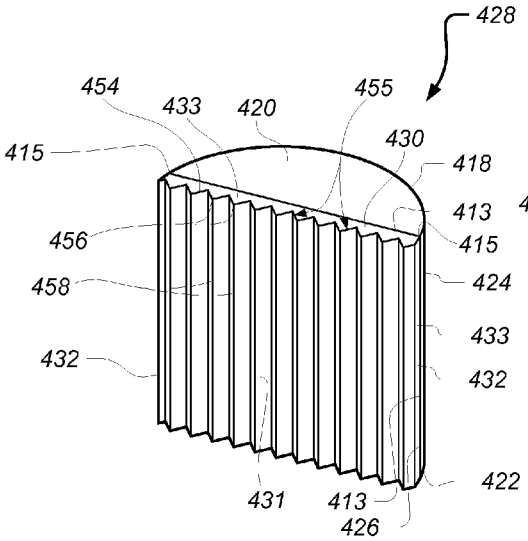
FIG. 9 is a perspective view of an exemplary cutting element according to at least one embodiment.
Figure 10:
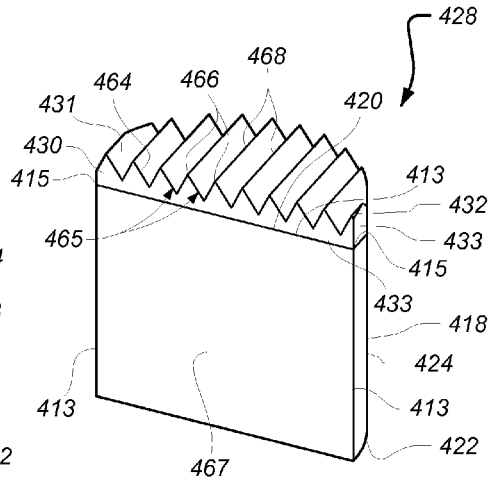
FIG. 10 is a perspective view of an exemplary cutting element according to at least one embodiment.

FIGS. 8-10 show exemplary cutting elements according to some embodiments. As shown in FIGS. 8-10, cutting elements 428 may each include a superabrasive layer 430 formed upon or affixed to substrate 418. According to some embodiments, substrate 418 may be formed from a substrate blank (e.g., substrate blank 10 illustrated in FIG. 1A). Substrate 418 may have a forward face 420, a rearward face 422, and a side surface 424. In some embodiments, forward face 420 and/or rearward face 422 may comprise a substantially planar surface. In at least one embodiment, forward face 420 may be substantially parallel to rearward face 422. According to various embodiments, side surface 424 may comprise an arcuate and/or semi-cylindrical surface. Substrate 418 may also include an interface surface 426 for bonding superabrasive layer 430 to substrate 418 (see, e.g., interface surface 26 illustrated in FIG. 1B).

Each substrate 418 may include one or more edges 413 where interface surface 426 intersects an adjacent surface, such as forward face 420 or side surface 424. Each substrate 418 may also include one or more points 415 where interface surface 426 intersects at least two surfaces, such as forward face 420 and side surface 424. Superabrasive layer 430 of each cutting element 428 may be affixed to or formed upon interface surface 426 or forward face 420 of substrate 418. Each cutting element 428 may comprise a superabrasive face 431, at least one superabrasive edge 432, and at least one superabrasive side surface 433 formed by superabrasive layer 430.

According to at least one embodiment, cutting elements 428 may each include a serrated cutting edge. For example, as shown in FIG. 8, a serrated cutting edge 450 may be formed by superabrasive layer 430 at and/or near an edge 413 of substrate 418 where interface surface 426 intersects forward face 420. Serrated cutting edge 450 may also be formed at or near any other suitable location, such as, for example, an edge 413 where interface surface 426 intersects side surface 424.

Serrated cutting edge 450 may comprise any suitable shape and/or configuration, without limitation. For example, serrated cutting edge 450 may comprise an angular and/or rounded edge following a zigzagging and/or meandering path. According to at least one embodiment, serrated cutting edge 450 may comprise an edge defined by a plurality of cutting points 452 and a plurality of cutting grooves 453 defined between cutting points 452. As illustrated in FIG. 8, cutting grooves 453 may extend between superabrasive face 431 of superabrasive layer 430 and at least a portion of substrate 418, such as forward face 420. In some embodiments, cutting grooves 453 may extend between superabrasive face 431 and superabrasive side surface 433 of superabrasive layer 430. Cutting grooves 453 may be formed in cutting element 428 by cutting and/or grinding and/or may be molded within the HPHT sintering process, without limitation. For example, cutting grooves 453 may be formed by cutting and/or grinding cutting element 428 along an oblique path with respect to superabrasive face 431 of superabrasive layer 430 and/or forward face 420 of substrate 418.

FIG. 9 shows a cutting element 428 having a serrated cutting edge 454 according to some embodiments. As illustrated in FIG. 9, serrated cutting edge 454 may be formed by superabrasive layer 430 at and/or near an edge 413 of substrate 418 where interface surface 426 intersects forward face 420. Serrated cutting edge 454 may comprise an angular and/or rounded edge following a zigzagging and/or meandering path. According to at least one embodiment, serrated cutting edge 454 may comprise an edge defined by a plurality of cutting points 456 and cutting ridges 458 and a plurality of cutting grooves 455 defined between cutting points 456 and cutting ridges 458.

As illustrated in FIG. 9, cutting ridges 458 and cutting grooves 455 may extend along superabrasive face 431 of superabrasive layer 430. For example, cutting ridges 458 and cutting grooves 455 may extend along the length of superabrasive layer 430 between a forward end and a rearward end of cutting element 428 (e.g., forward end 247 and rearward end 249 illustrated in FIG. 7B). Cutting grooves 455 may be formed in cutting element 428 by cutting and/or grinding and/or may be molded within the HPHT sintering process, without limitation. For example, cutting grooves 455 may be formed by cutting and/or grinding cutting element 428 along a path that is substantially parallel to interface surface 426 of substrate 418.

FIG. 10 shows a cutting element 428 having a serrated cutting edge 464 according to some embodiments. As illustrated in FIG. 10, superabrasive layer 430 of cutting element 428 may be bonded to forward face 420 of substrate 418. Serrated cutting edge 464 may be formed by superabrasive layer 430 at and/or near an edge 413 of substrate 418 where a side surface 467 intersects forward face 420. According to some embodiments, side surface 467 may comprise a substantially planar surface. Serrated cutting edge 464 may comprise an angular and/or rounded edge following a zigzagging and/or meandering path. According to at least one embodiment, serrated cutting edge 464 may comprise an edge defined by a plurality of cutting points 466 and cutting ridges 468 and a plurality of cutting grooves 465 defined between cutting points 466 and cutting ridges 468.

As illustrated in FIG. 10, cutting ridges 468 and cutting grooves 465 may extend along forward face 420 of substrate 418 and along a superabrasive side surface 433 of superabrasive layer 430. For example, cutting ridges 458 and cutting grooves 455 may extend along superabrasive face 431 of superabrasive layer 430. For example, cutting ridges 468 and cutting grooves 465 may extend along superabrasive layer 430 in a direction that is substantially parallel to forward face 420. Cutting grooves 465 may be formed in cutting element 428 by cutting and/or grinding and/or may be molded within the HPHT sintering process, without limitation. For example, cutting grooves 465 may be formed by cutting and/or grinding cutting element 428 along a path that is substantially parallel to forward face 420 of substrate 418. According to at least one embodiment, serrated cutting edges, such as serrated cutting edges 450, 454, and/or 464 shown in FIGS. 8-10, may enable at least a portion of cutting element 418, such as substrate 418 and/or superabrasive layer 430, to be formed with a relatively smaller cross-sectional area and/or thickness without reducing the cutting effectiveness of cutting element 418. According to various embodiments, serrated cutting edges 450, 454, and/or 464 may provide a more aggressive cutting edge on cutting element 428 for cutting various materials during cutting and/or drilling operations. Additionally, serrated cutting edges 450, 454, and/or 464 may enable cutting element 428 to maintain a more effective cutting edge as cutting element 428 becomes worn through use.

Figure 11A:
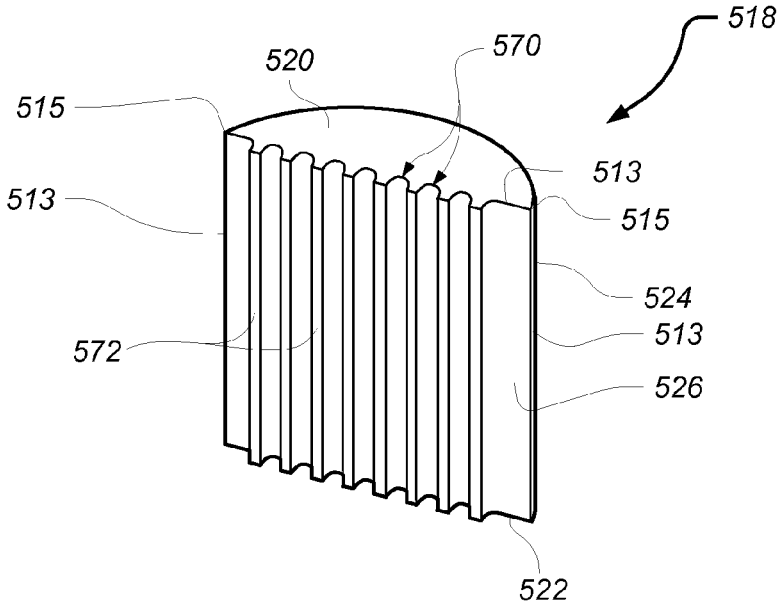
FIG. 11A is a perspective view of an exemplary substrate according to at least one embodiment.
Figure 11B:
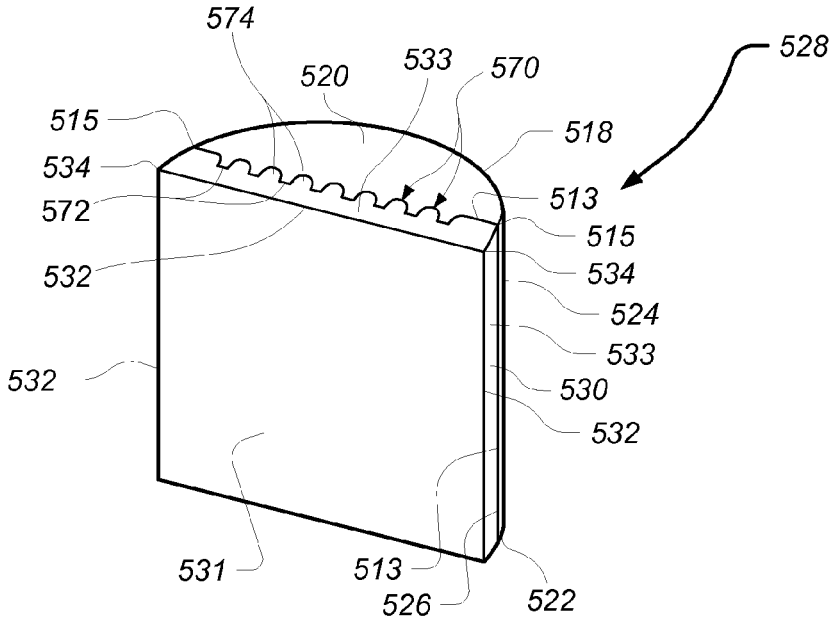
FIG. 11B is a perspective view of an exemplary cutting element comprising the exemplary substrate illustrated in FIG. 11A according to at least one embodiment.

FIG. 11A shows an exemplary substrate and FIG. 11B shows an exemplary cutting element comprising the substrate illustrated in FIG. 11A according to various embodiments. As shown in FIG. 11A, substrate 518 may be formed from a substrate blank (e.g., substrate blank 10 illustrated in FIG. 1A). Substrate 518 may have a forward face 520, a rearward face 522, and a side surface 524. In some embodiments, forward face 520 and/or rearward face 522 may comprise a substantially planar surface. In at least one embodiment, forward face 520 may be substantially parallel to rearward face 522. According to various embodiments, side surface 524 may comprise an arcuate and/or semi-cylindrical surface. Substrate 518 may also include an interface surface 526 for bonding a superabrasive layer to substrate 518. Substrate 518 may include one or more edges 513 where interface surface 526 intersects an adjacent surface, such as forward face 520 or side surface 524. Substrate 518 may also include one or more points 515 where interface surface 526 intersects at least two surfaces, such as forward face 520 and side surface 524.

According to at least one embodiment, substrate 518 may include grooves for affixing a superabrasive layer to substrate 518. For example, as illustrated in FIG. 11A, a plurality of substrate grooves 570 may be formed between substrate ridges 572 in interface surface 526 of substrate 518. Substrate grooves 570 and substrate ridges 572 may be formed to any suitable shape and/or configuration, without limitation. Substrate grooves 570 and/or substrate ridges 572 may extend along at least a portion of interface surface 526. For example, as illustrated in FIG. 11A, substrate grooves 570 and substrate ridges 572 may extend along the length of superabrasive layer 530 between a forward end and a rearward end of cutting element 528 (e.g., forward end 247 and rearward end 249 illustrated in FIG. 7B).

A superabrasive layer may be affixed to or formed upon interface surface 526 of substrate 518. For example, FIG. 11B shows a cutting element 528 comprising a superabrasive layer 530 affixed to interface surface 526 of substrate 518. Cutting element 528 may comprise a superabrasive face 531, at least one superabrasive edge 532, at least one superabrasive side surface 533, and at least one superabrasive point 534 formed by superabrasive layer 530. Superabrasive layer 530 may be affixed to substrate 518 such that portions of superabrasive layer 530 extend into substrate grooves 570 between substrate ridges 572. For example, superabrasive layer 530 may include superabrasive ridges 574 occupying substrate grooves 570 such that superabrasive ridges 574 of superabrasive layer 530 are interlocked with substrate ridges 572 of substrate 518. Accordingly, superabrasive layer 530 may be securely adhered to substrate 518. Other examples of superabrasive elements including superabrasive layers affixed to substrates having ridges and grooves, as disclosed herein, may be found in U.S. Pat. Nos. 4,784,023 and 5,120,327, the disclosure of each of which is incorporated herein, in its entirety, by this reference.

The preceding description has been provided to enable others skilled in the art to best utilize various aspects of the exemplary embodiments described herein. This exemplary description is not intended to be exhaustive or to be limited to any precise form disclosed. Many modifications and variations are possible without departing from the spirit and scope of the instant disclosure. It is desired that the embodiments described herein be considered in all respects illustrative and not restrictive and that reference be made to the appended claims and their equivalents for determining the scope of the instant disclosure.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising."

What is claimed is:

1. A cutting element for a rotary drill bit, the cutting element comprising:
- a forward end;
- a rearward end;
- a substrate comprising:
  - a forward face;
  - a rearward face;
  - an interface surface extending between the forward end and the rearward end;
- a superabrasive layer bonded to the interface surface of the substrate, the superabrasive layer comprising a first cutting edge and a second cutting edge each extending from the forward end to the rearward end;
- wherein:
  - at least one of the forward face and the rearward face comprises a substantially planar surface;
  - the substrate comprises an arcuate side surface extending from a first edge of the interface surface adjacent the first cutting edge to a second edge of the interface surface adjacent the second cutting edge.

2. The cutting element of claim 1, wherein the forward face is substantially parallel to the rearward face.

3. The cutting element of claim 1, wherein the interface surface comprises a substantially planar surface.

4. The cutting element of claim 1, wherein the interface surface comprises an arcuate surface.

5. The cutting element of claim 1, wherein the arcuate side surface comprises a semi-cylindrical surface.

6. The cutting element of claim 1, further comprising another cutting edge that is formed where the interface surface intersects the forward face.

7. The cutting element of claim 1, further comprising at least one cutting point that is formed where the interface surface, the forward face, and the arcuate side surface extending from the at least one interface surface intersect.

8. The cutting element of claim 1, wherein the superabrasive layer comprises a polycrystalline diamond material.

9. The cutting element of claim 1, wherein the superabrasive layer comprises a serrated cutting edge having a plurality of cutting points and a plurality of grooves defined between the cutting points.

10. The cutting element of claim 1, wherein:

the interface surface of the substrate comprises a plurality of spaced apart ridges forming grooves therebetween;

the superabrasive layer occupies the grooves such that the superabrasive layer is interlocked with the ridges of the substrate.

11. The cutting element of claim 1, wherein the substrate comprises a half-circular cross section.

12. A rotary drill bit, comprising:

a bit body rotatable about a longitudinal axis in a rotational direction;

at least one cutting element coupled to the bit body, the at least one cutting element comprising:

a rearward end adjacent to the bit body;

a forward end extending away from the bit body;

a substrate comprising a forward face;

a rearward face;

an interface surface extending between the forward end and the rearward end;

a superabrasive layer bonded to the interface surface of the substrate, the superabrasive layer comprising a first cutting edge and a second cutting edge each extending from the forward end to the rearward end;

wherein the substrate comprises an arcuate side surface extending from a first edge of the interface surface adjacent the first cutting edge to a second edge of the interface surface adjacent the second cutting edge.

13. The rotary drill bit of claim 12, wherein the forward face of the substrate is within 30° of being perpendicular to the longitudinal axis.

14. The rotary drill bit of claim 12, wherein the arcuate side surface is positioned on a side of the at least one cutting element facing in a direction that is generally opposite the rotational direction.

15. The rotary drill bit of claim 12, further comprising:

two interface surfaces;

at least one cutting edge formed where the two interface surfaces intersect.

16. The rotary drill bit of claim 12, wherein at least one of the first cutting edge and the second cutting edge is positioned on a side of the at least one cutting element facing generally in the rotational direction.

17. The rotary drill bit of claim 12, further comprising at least one bit blade having a leading face that faces generally in the rotational direction, wherein the at least one cutting element is mounted on the at least one bit blade such that at least one of the first cutting edge and the second cutting edge is positioned rotationally preceding the leading face in the rotational direction.

18. The rotary drill bit of claim 17, wherein the at least one cutting element is mounted to the at least one bit blade such that the forward face of the at least one cutting element is within 30° of being perpendicular to the leading face of the at least one bit blade.

19. The rotary drill bit of claim 12, wherein the substrate comprises a half-circular cross section.

* * * * *